US005112037A

United States Patent [19]

Holbrook

[11] Patent Number: 5,112,037

[45] Date of Patent: May 12, 1992

[54] FRONT FEEDER FOR LARGE SIZE MAIL HANDLING MACHINE

[75] Inventor: Russell W. Holbrook, Middlebury, Conn.

[73] Assignee: Pitney Bowes Inc., Stamford, Conn.

[21] Appl. No.: 633,726

[22] Filed: Dec. 24, 1990

[51] Int. Cl.[5] ..... B65H 5/00

[52] U.S. Cl. ..... 271/2; 271/250; 271/161; 271/165

[58] Field of Search ..... 271/2, 9, 119, 145, 271/161, 165, 166, 171, 248, 250, 126, 236

[56] References Cited

U.S. PATENT DOCUMENTS 3,977,668 8/1976 Bologna et al. ..... 271/126
4,193,590 3/1980 Mongagnino ..... 271/165 X
4,850,580 7/1989 Denzin et al. ..... 271/119 X
4,930,764 6/1990 Holbrook et al. .

FOREIGN PATENT DOCUMENTS 189937 11/1982 Japan ..... 271/145

*Primary Examiner*—Robert P. Olszewski
*Assistant Examiner*—Boris Milef
*Attorney, Agent, or Firm*—Charles G. Parks, Jr.; David E. Pitchenik; Melvin J. Scolnick

[57] ABSTRACT

A front-end feeder for a mixed mail handling machine employs a raised deck portion spaced from a registration wall for the mail pieces. The raised deck portion, preferably a plurality of fixed steps of increasing height, provides additional tilting and guidance of wide mail pieces to prevent mis-registration.

6 Claims, 3 Drawing Sheets

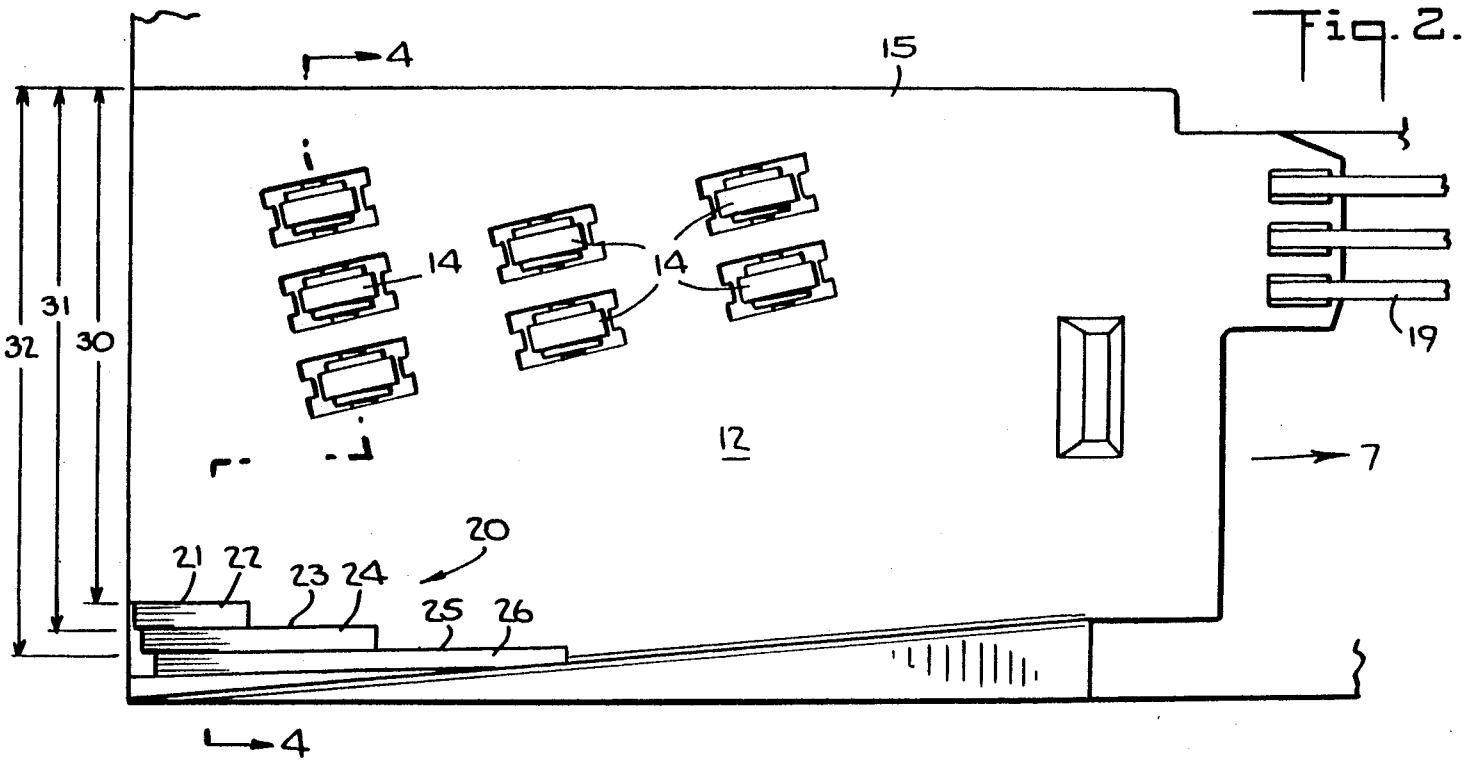
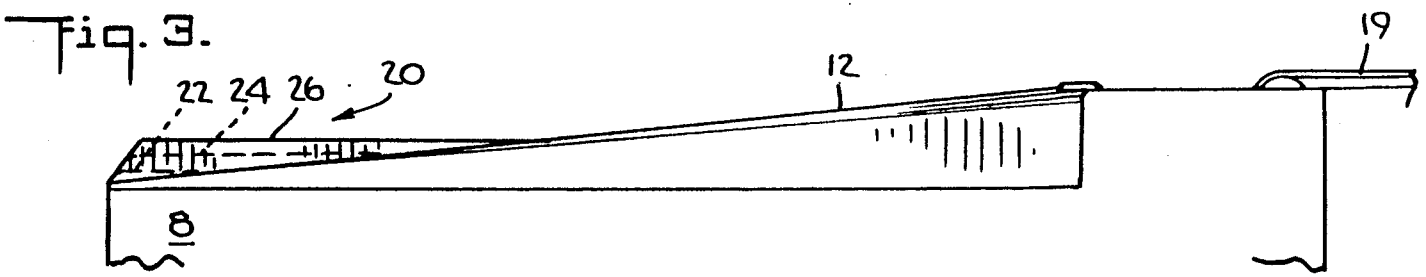
Fig. 3.

FRONT FEEDER FOR LARGE SIZE MAIL HANDLING MACHINE

This invention relates to a front end feeder specially adapted for a mail handling machine, and in particular to a front end feeder capable of properly feeding large as well as small sized articles.

BACKGROUND OF INVENTION

In a prior filed patent application, issued as U.S. Pat. No. 4,930,764, whose contents are hereby incorporated by reference, a front end feeder for a high speed machine for handling mixed mail is described. The front feeder comprises a hopper region with a deck which is flat and in which is embedded a series of drive wheels which are angled toward a rear registration wall. The deck is angled slightly backwards and slightly towards the registration wall. When a stack of envelopes intended to be sealed and posted in this machine are loaded into the hopper, the function of the front feeder is to pre-shingle the mail while moving it downstream toward a singulator located downstream of the hopper. It is important that the envelopes be maintained in registration with this rear registration wall as they approach and enter the singulator.

While the mechanism described in this earlier patent performs extremely well in connection with average mail sizes, it has been found that on occasion, from time to time, very wide mail also known as flats tend to become misregistered. In other words, the very wide mail tend not to be maintained in registration with the rear registration wall as the envelopes are moved in a downstream direction towards the singulator.

SUMMARY OF INVENTION

The principal object of the invention is an improved front feeder for stacked articles which is capable of maintaining articles varying in size from small to large in proper registration against the registration wall while they are fed in a downstream direction for further processing.

The invention is based upon the recognition that the problem of the misregistration of very wide mail or flats is a result of the location of the transport means or the jostling or bouncing which the mail may be subjected to by the transport means in the hopper. In order to ensure that even the smallest size mail is adequately moved downstream to the singulator, the transport means, which in the preferred embodiment comprises a plurality of angled drive wheels, are located relatively close to the registration wall. As a result with very wide mail, the drive wheels, which are eccentric, extend under only one half or less of the width of the wide mail piece. Thus the driving action as a result of the frictional engagement of the drive wheels with the mailpiece is concentrated at only one side of the envelope, and together with the jostling of the eccentric wheels, on occasion, may cause the envelope to move or "walk" away from the registration wall instead of toward it.

In accordance with one aspect of the present invention, means are provided on the hopper deck in order to provide an additional force and guidance for very wide mail which tends to push and confine it toward the registration wall. This additional force and guidance is effective only on mail pieces exceeding a certain width and is not operative on narrower size mail. As a result, the deck can be divided into two regions, a first region located adjacent the registration wall which can have the same construction as is described in the above-identified patent, that is, it can as before be tilted slightly backwards and slanted slightly toward the registration wall. Thus, most sized mail pieces are handled in exactly the same manner as they were on the machine described in said patent. However, at a second region of the deck spaced from the registration wall, additional structure is provided which further tilts and guides wide mail pieces only toward the registration wall. This additional structure and this additional tilting and guiding of the mailpieces offset the tendency of the transport means to on occasion cause very wide mail to be pushed away rather than toward the registration wall.

In accordance with a further aspect of the invention, this additional structure which provides the additional guidance force and the additional tilting of very wide mailpieces comprises at least one raised step integral with the deck. The step riser is so spaced from the registration wall that the step engages only mailpieces exceeding a certain width.

In accordance with a further aspect of the invention, a plurality of raised steps is provided, each of an increasing height and each being further spaced from the registration wall. The result is that as the mail to be handled increases in width, it becomes subject to guidance by the outer steps and its angle of tilt with respect to the registration wall also increases. In a preferred embodiment, the spacing of the step risers from the registration wall correspond to certain mail width ranges so that different sizes of mail are subject to a guidance action before undergoing harmful skew.

In accordance with an alternative embodiment of the invention, the additional force and or tilting means is provided by a curved surface that curves upwardly and outwardly starting at a point that is spaced from the registration wall so that it is effective to tilt only very wide mail or flats.

These and other features and advantages will become clearer from the description given below of several embodiments of a front end feeder in accordance with the invention, taken in conjunction with the accompanying drawings.

SUMMARY OF DRAWINGS

In the drawings:

FIG. 2 is a top plan view of the deck portion of the front end feeder of FIG. 1;

FIG. 3 is a front elevational view of the front end feeder illustrated in FIG. 2;

DETAILED DESCRIPTIONS OF PREFERRED EMBODIMENTS

The front end feeder of the present invention is similar in many respects to the front end feeder described in the referenced U.S. Pat. No. 4,930,764, and its operation of transporting a stack of mail and pre-shingling it for proper submission to the downstream shingler is essentially the same in the present invention as it is in the aforesaid patent. For purposes of the present invention, it will suffice for a complete understanding to describe merely the added feature of handling large mail envelopes. The manner in which the machine of the invention handles the ordinary size or smaller size envelopes is identical to that described in the patent. For a more detailed description of the operation of the machine, reference should be had to the aforesaid patent. The present description will thus just briefly summarize the main structural features of the front end feeder which provides the environment for understanding the present invention.

Figure 1:
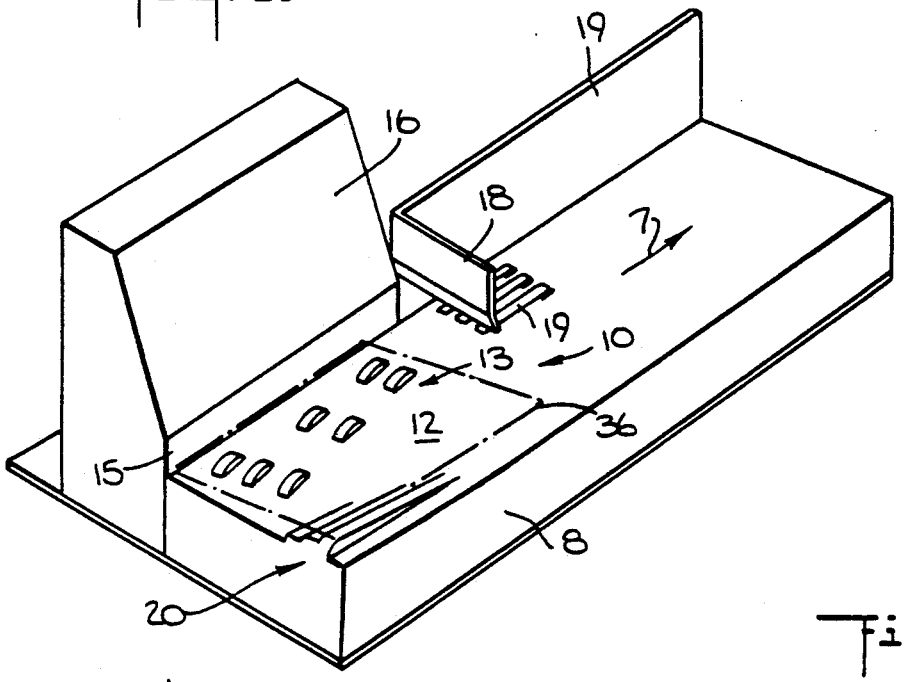
FIG. 1 is a perspective view of the front end feeder part of a mail handling machine in accordance with one embodiment of the invention.

The machine illustrated in FIG. 1 comprises a base member 8 along the top of which at the left end is provided a hopper area 10 for receiving a stack of mail to be processed. Overlying the top of the base is a deck 12 which for the most part is flat. As described in the referenced patent, the deck can have a small backward tilt (to the left in FIG. 1) which assists in the preshingling action, as well as a small slant toward the rear of the machine. In this case, the rear of the deck 12 is defined by a registration wall 15 which extends vertically alongside the deck edge 12. That registration wall 15 can be part of a tamper subsystem 16 which, as explained in the patent, is useful for tamping overlying envelope flaps as the unsealed mail pieces are fed downstream. The downstream direction for the machine illustrated is indicated by the arrow 7. Just downstream of the hopper area 10 is structure 18 for guiding the envelopes downstream as well as a transport mechanism 19 represented by the three belt drives illustrated for a singulator (not shown). The downstream part of the deck is also closed off at the rear by a wall 19 which also serves as a registration wall for an envelope edge.

Transport means 13 are provided in a hopper area 10 for moving the mail pieces in a downstream direction. Similarly to the construction in the patent, the transport means is herein represented by seven friction drive wheels 14 mounted for rotation in the deck 12, the surfaces of the drive wheels extending through deck openings a short distance over the deck level.

The drive wheels 14, it will be observed, are positioned relatively close to the registration wall 15. This is to ensure that even the narrowest mail piece can be adequately moved downstream along the machine. But when wider envelopes or flats as they are sometimes called are placed in the hopper area then the drive wheels are located under only the rear half of the envelope. This produces a friction force on the envelope which is concentrated at only the rear half. Even though the drive wheels are angled toward the registration wall, due to the offset drive action and drive wheel jostling, on occasion a wide envelope will be moved away or "walk" off the feed deck to the machine front and lose its edge registration with the registration wall 15. When this happens, then that envelope can no longer be properly processed by the remainder of the mail machine and will cause the machine to come to a halt. It has been found that the problem only exists with respect to wide mail pieces. The machine described in the patent adequately handles the narrow sized mail.

In accordance with a feature of the invention, structure is provided on the deck 12 to provide an additional force and guidance which causes the wider mailpieces to be urged and contained toward and against the registration wall 15. In accordance with a preferred embodiment of the invention, this additional structure comprises a series of raised steps mounted on the deck but spaced from the registration wall. When larger envelopes are placed in the hopper 10, they will span the distance between one of the steps and the registration wall and thus the front edge of the wider mail piece would rest on one of the steps while the remainder of the envelope will continue to sit on the deck or actually on the protruding drive wheels at the deck surface. This functions to prop up the envelope front edge and tilt the envelope, thus providing an additional guidance force which tends to push the envelope towards the rear registration wall 15. Providing several steps allows mail of greater width to be guided toward the registration wall before the envelope skew becomes unacceptable. Thus, a plurality of raised steps is provided which gradually increase in height as their spacing from the registration wall increases.

Figure 5:
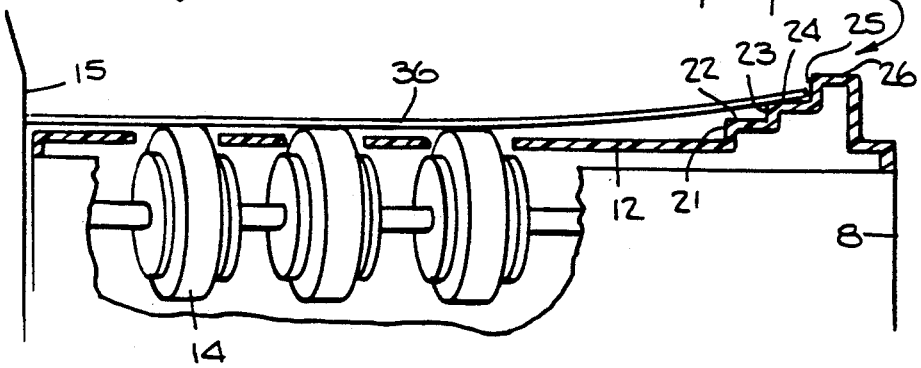
FIGS. 4 and 5 are cross-sectional views through the line 4—4 of FIG. 2 illustrating the operation of the front end feeder of the invention with different sized mail pieces.

In FIG. 1, the step structure is indicated generally at 20, and comprises three steps which extend substantially parallel in a downstream direction to the registration wall 15. In addition, as will be observed, the steps are tapered downward in the downstream direction. The tapers are the same for each of the three steps with the result that they extend in the downstream direction increasingly longer lengths but end well short of the downstream end of the hopper area 10. As illustrated in FIG. 5, the step structure consists of a first step riser 21, first step 22, second step riser 23, second step 24, a third step riser 25, and a third step 26. The step structure is built into and integral with the deck surface 12 and is fixed. A typical step height would be about $\frac{1}{8}$ inch, and a typical step width about $\frac{3}{8}$ inch. Thus, one of the characteristic features of this mailing machine is retained. This feature is the guideless hopper. Unlike most other mailing machines, there are no adjustable side props or side guides, or guides in front that the operator must adjust to hold the stack of mail in place. By eliminating the need for such guides, the feeder of the invention, similarly to the one described in the U.S. Pat. No. 4,930,764, can truly be a mixed mail feeder that is capable of handling mail of varying sizes, both flap and unflapped.

FIG. 2 shows the length of each of the steps 22, 24, 26 in the downstream direction of the machine. As will be observed, each step is roughly twice as long as the previous step but even the longest step 26 occupies less than 50 percent of the downstream length of the hopper region. Even though the stack of mail provided at the left end of the machine hopper region 10 exceeds the step height initially, the pre-shingling action of the front end feeder will always advance the lowest mail piece at the stack bottom first, which, if wide enough, will become subject to the propping or guidance action of the raised steps. It will also be observed from FIG. 2 that the shortest step nearest to the registration wall 15 is spaced a considerable distance from the registration wall 15. That distance is represented by the reference numeral 30 and corresponds roughly to about 70 to 80 percent of the total distance from the registration wall 15 to the front of the machine. Thus all flat mail which has a width equal to or smaller than the distance 30 are processed as described in the earlier patent. It is only mail pieces whose width exceeds the distance 30 that become subject to the additional rearward force and guidance provided by the tilting of the envelope as its front edge rests on one of the steps.

Figure 4:
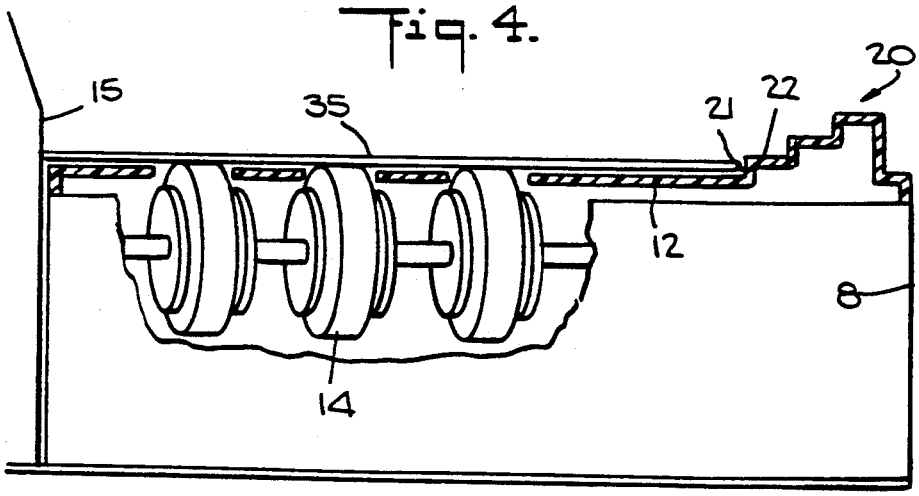

In FIG. 4, an envelope is shown being processed by the machine. The envelope is referenced 35 and as will be observed lies flat on the deck 12 between the first step riser 21 and the registration wall 15. FIG. 5 illustrates another envelope being processed, which envelope is referenced 36 and, as will be observed, this wider envelope rests in part over the flat deck 12 with its front outer edge lying on the second step 24. As the envelope is moved downstream, that step gradually decreases in height, as illustrated in FIG. 1, and eventually smoothly merges, just like the other steps, into the deck surface 12. But, during that critical part of the envelope movement and until it comes under the control of the downstream transport mechanism 19, that additional force and guidance provided on the front outer edge of the envelope will overcome the problem of the envelope on occasion "walking" off the deck. The envelope 36 is also shown in dash-dot lines in FIG. 1, from which it will be observed that before the envelope 36 clears the steps 20, it will come under the control of the downstream transport 19. FIG. 3 also illustrates the backward angling of the deck 12 which is described in the referenced patent. The drawings in this case do not show the slanting of the deck toward the registration wall 15.

Figure 7:
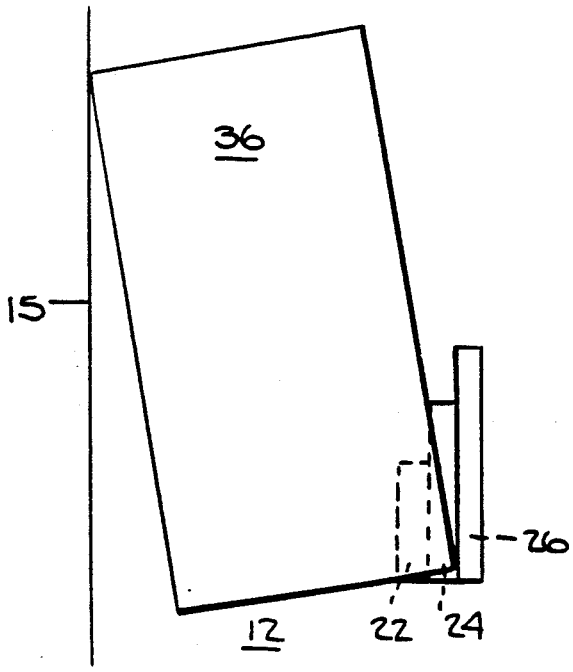
FIG. 7 illustrates envelope skew.

FIG. 7 illustrates the action, showing a slightly skewed envelope 36. The downstream singulator is tolerant of a small amount of envelope skew; therefore a step need not be provided for every envelope width. It is sufficient if the step width can accommodate a small range of envelope widths. Generally, a step width less than one-half inch will be acceptable, with three-eighths inch being preferred. Thus in FIG. 2, each of the distances referenced 31 and 32 would be three-eighths inch larger than the preceding distance. The worst case occurs when the envelope width just exceeds one riser spacing. Then it can undergo the most skew before reaching the downstream transport. FIG. 7 illustrates an acceptable amount of skew. Were the step width too large, the mailpiece would be able to skew past a tolerable range.

It will be understood that the invention is not limited to a machine of the type illustrated in the earlier patent. It can be used in any kind of a mail handling machine, and for that matter in any kind of an article handling machine which is designed for handling mixed mail or mixed sized articles and in which there may be a tendency for wider mail or wider articles to lose their edge registration with a registration wall as they are being transported downstream for further processing by the machine. Similarly, this feature of the present invention does not require that the deck be angled backwards or slanted toward the registration wall. Nor, it will be obvious, is the invention limited to the particular kind of transport mechanism illustrated using the seven angled friction rollers 14.

Figure 6:
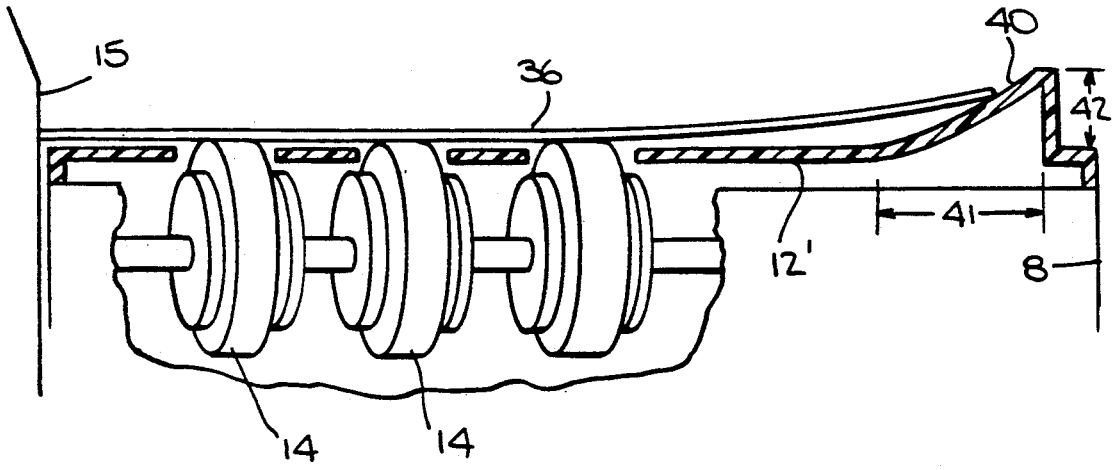
FIG. 6 is a cross-sectional view corresponding to FIG. 4 of a modified front end feeder of the invention.

FIG. 6 shows an alternative embodiment. In this alternative, instead of steps rising above the deck level adjacent the front part of the machine, the deck surface 12, curves upwardly and outwardly toward the front. The curved portion of the deck in this case is designated 40. Preferably, the curve is parabolic but this is not essential. As will observed, it starts to curve at about the same position on the deck 12, corresponding to the location of the first step riser 21, and the highest end of the curve is about the same height above the deck as is the third step 26 in the first embodiment. Moreover, the curved part extends downstream only over a small portion of the hopper region similar to that of the steps 20. A suitable width 41 of the curved deck portion 40 is about 1–1.5 inch, and a suitable height 42 is about 0.75–1 inch. A wide mail envelope is shown at 36'. This curved deck region performs essentially the same function on wider mail pieces as does the step construction of the first embodiment. The latter is preferred, because the step riser also provide a modest restraining force which assists in achieving the desired registration, which feature is lacking in the curved deck of the second embodiment.

While the invention has been described and illustrated in connection with preferred embodiments, many variations and modifications as will be evident to those skilled in this art may be made therein without departing from the spirit of the invention, and the invention as set forth in the appended claims is thus not to be limited to the precise details of construction set forth above as such variations and modifications are intended to be included within the scope of the appended claims.

What is claimed is:

1. An improved feeder apparatus for stacked articles of different sizes comprising:

(a) a hopper region for receiving a stack of the articles, said hopper region comprising:

(i) a deck along which the articles are to be fed in a downstream direction, (ii) a registration wall alongside the deck and substantially parallel to the downstream direction, (b) transport means in the deck for moving the articles in the downstream direction, the improvement comprising (c) guiding means associated with the deck for guiding only the larger width articles toward the registration wall to prevent misregistration of larger width articles, wherein the guiding means includes a fixed plurality of steps at different heights, each higher step being spaced further from the registration wall.

2. An improved feeder apparatus as claimed in claim 1, wherein the articles are flat mail pieces, and includes a plurality of step risers connected to said steps such that the spacing between each step riser and the registration wall corresponds to different ranges of widths of mail pieces.

3. An improved feeder apparatus as claimed in claim 1, wherein each of the steps has a width of about ⅜ inch.

4. In an improved front end feeder apparatus for stacked mail articles of different sizes comprising:

(a) a hopper region for receiving a stack of generally flat mail pieces, said hopper region comprising a deck having a first flat region, and a registration wall adjacent one side of the flat deck region and defining a downstream direction substantially parallel to the registration wall for the mail pieces, and (b) transport means in the hopper region for moving the mail pieces toward the registration wall while simultaneously moving them in a downstream direction, the improvement comprising:

(c) said deck having a second fixed non-flat region remote from the registration wall that extends at a higher level than said first region adjacent the registration wall, whereby mail pieces spanning both the first and second regions are subject to a guidance force thereby providing an additional force for guiding them towards the registration wall wherein misregistration of larger size mail articles is prevented (d) said second non-flat region having a fixed plurality of steps of increasing height and increasing spacing from the registration wall.

5. An improved front end feeder apparatus as claimed in claim 4, wherein the first flat deck region extends the full length of the hopper region parallel to the registration wall, the second non-flat deck region extending only over a distance in the hopper length direction that is substantially shorter than that of the first deck region.

6. An improved front end feeder apparatus as claimed in claim 5, wherein a second transport means is located downstream of the hopper transport means, said mail pieces having a given length, said non-flat region terminating at a position such that it no longer supplies a guidance force when the mail pieces come under the control of the downstream transport means.

* * * * *